United States Patent [19]

Edblom et al.

[11] 4,225,386

[45] Sep. 30, 1980

[54] HEADBOX FOR A PAPER MACHINE

[75] Inventors: Karl G. Edblom; Kenneth I. Nordin; Per O. Staaf; Erik G. Stenberg; Nils-Erik Strand, all of Karlstad; Bo L. H. Svensson, Molkom, all of Sweden

[73] Assignee: Aktiebolaget Karlstads Mekaniska Werkstad, Karlstad, Sweden

[21] Appl. No.: 21,443

[22] Filed: Mar. 19, 1979

[51] Int. Cl.[3] ..... D21F 1/02

[52] U.S. Cl. ..... 162/343

[58] Field of Search ..... 162/343

[56] References Cited

U.S. PATENT DOCUMENTS

| | | | |
|---|---|---|---|
| 3,309,264 | 3/1967 | Parker et al. | 162/343 X |
| 3,535,203 | 10/1970 | Nilsson | 162/343 |
| 3,725,197 | 4/1973 | Dahl et al. | 162/343 |
| 3,962,031 | 6/1976 | Bubik et al. | 162/343 X |
| 4,070,238 | 1/1978 | Wahren | 162/343 |
| 4,146,427 | 3/1979 | Högel et al. | 162/343 |

*Primary Examiner*—Richard V. Fisher

*Attorney, Agent, or Firm*—Brumbaugh, Graves, Donohue & Raymond

[57] ABSTRACT

Stock flow alignment means for the headbox of a paper machine or the like comprises a plurality of composite tubes having their opposite ends mounted in apertures in two spaced apart tube plates extending in the cross machine direction. Each composite tube includes first and second tubular elements assembled in telescoping relation to accommodate changes in length resulting from thermal expansion. Also, each composite tube is formed with a stepwise enlargement of its cross section in the direction of flow near the telescoped ends of the tubular elements. Flow deflector means disposed in the flow paths to the inlet ends of the composite tubes prevent fibers in the stock from collecting at the inlets.

18 Claims, 7 Drawing Figures

HEADBOX FOR A PAPER MACHINE

BACKGROUND OF THE INVENTION

The present invention relates to a headbox for a paper machine, and more specifically to a headbox including a stock flow aligning device having means defining a plurality of flow channels arranged in rows extending substantially in the cross machine direction, each of said channels enlarging stepwise in the direction of stock flow therethrough.

The use of hole plates in headboxes for paper machines and similar machinery has long been known. To align the flow and eliminate cross flow tendencies, such hole plates have been made thicker and thicker (see e.g. U.S. Pat. No. 3,725,197) and have developed into blocks having channels drilled therethrough, suitably widened stepwise in the direction of stock flow. Such blocks have sufficient rigidity to take up the load from the stock pressure equally across the headbox dimension in the cross machine direction, so that changes in load do not cause unequal changes in the machine geometry.

Due to the size and weight of the block and the costs involved, attempts have been made to replace them by banks of tubes of considerable length in relation to their diameter, the opposite ends of the tubes being firmly clamped in tube plates disposed in fixed, spaced apart relation to each other. If the paper machine is started with the stock at a considerably different temperature than the tube bank, as is often the case, differential expansion is likely to produce resultant forces great enough to deform the headbox and cause small, but vital, changes in the geometry of the headbox slice opening. Before steady conditions are attained, which can take 8–12 hours, the paper machine will be difficult to control, the quantities of broke large, and the frequency of web breaks increased, resulting in production losses, rejects, and unsatisfactory operation. In addition, the resultant forces can be of the same order of magnitude as the forces retaining the tube ends in the plates, so that tube end clamping can fail and result in leakage.

SUMMARY OF THE INVENTION

The principal object of the present invention is to provide a new and improved headbox apparatus embodying stock flow alignment means that is relatively light in weight, low in total cost, and sufficiently rigid, yet is not susceptible to damage or unfavorable effects resulting from differential thermal expansion.

This is accomplished, according to the invention, by aligning the flow of stock in a headbox by passing it through a bank of tubes, each comprising a first tubular element of given cross sectional area having one end telescoped in one end of a second tubular element of greater cross sectional area, sealing means being provided to prevent the leakage of stock between the two telescoped ends. The other ends of the first and second tubular elements, respectively, are fixedly and watertightly mounted in holes formed in a pair of tube plates disposed in fixed spaced apart relation. By virtue of the telescoping relation between the adjacent ends of the first and second tubular elements comprising each tube, stepwise enlargement of the channel is readily effected and changes in length caused by differential thermal expansion can readily be accommodated.

In one embodiment, the free end of each tubular element of smaller cross sectional area may be fitted with a sleeve adapted to be snugly received in the free end of a tubular element of greater cross sectional area, suitable sealing means being provided to seal the joint between the outer surface of the sleeve and the inner surface of the tubular element. In another embodiment, the tubular elements of smaller cross sectional area may comprise bushings adapted to be snugly received in telescoping relation in the respective free ends of the tubular elements of greater cross sectional area, the bushing having flanges mounted in recesses formed in the upstream side of the upstream tube plate, suitable liquid-tight seals being provided both at the telescoping joints and at the joints between the flanges and recesses. Each bushing has a central bore smaller than the cross sectional area of the free end of the tubular element into which it is telescoped, providing a channel that increases stepwise in size in the direction of flow.

In either or both forms of the invention, a detachable hole plate may be provided on the upstream side of the tube plate to which the tubular elements of smaller cross sectional area are secured. Such hole plate may have flow restricting apertures therein in line with the respective tubular elements.

In headboxes where the stock flows in the cross machine direction to the upstream ends of the tubular elements secured to the upstream tube plate and then changes direction as it enters the tubular elements, the invention contemplates the provision of flow deflector means projecting into the stock flow immediately upstream of the inlets to the tubular elements. Such flow deflector means is preferably formed with a slowly rising upstream side and a steep downstream side sloping downwardly towards the inlet to prevent fibers in the stock from collecting at the inlet. Each inlet may be provided with flow deflector means, or a single flow deflector may be common to several inlets in a row in the direction of flow.

Desirably, the stepwise enlargement of each channel formed by the two telescoped tubular elements should be such that at the free end of each tubular element of smaller cross section, the channel diverges at an aperture angle of about 1 radian and preferably about $\pi/2$ radians. Also, in many cases, the channels may have at least two such stepwise enlargements.

The composite tubes may desirably be disposed in rows spaced apart in the machine direction and columns spaced apart in the cross machine direction, the angle between each row and column being between about 1 radian and $\pi/2$ radians. Suitably, there should be at least five rows of composite tubes, and the latter should be disposed at equal pitches in the rows and columns. In some cases, the angle between the rows and columns may be oblique and the angle and the pitch may be selected so that the projections of the center lines of all of the tubes on a plane parallel thereto and extending in the cross machine direction are located at equal distances from each other.

DESCRIPTION OF THE PREFERRED EMBODIMENTS

The invention may be better understood from the following detailed description of several representative embodiments, taken in conjunction with the accompanying drawings, in which.

Figure 1:
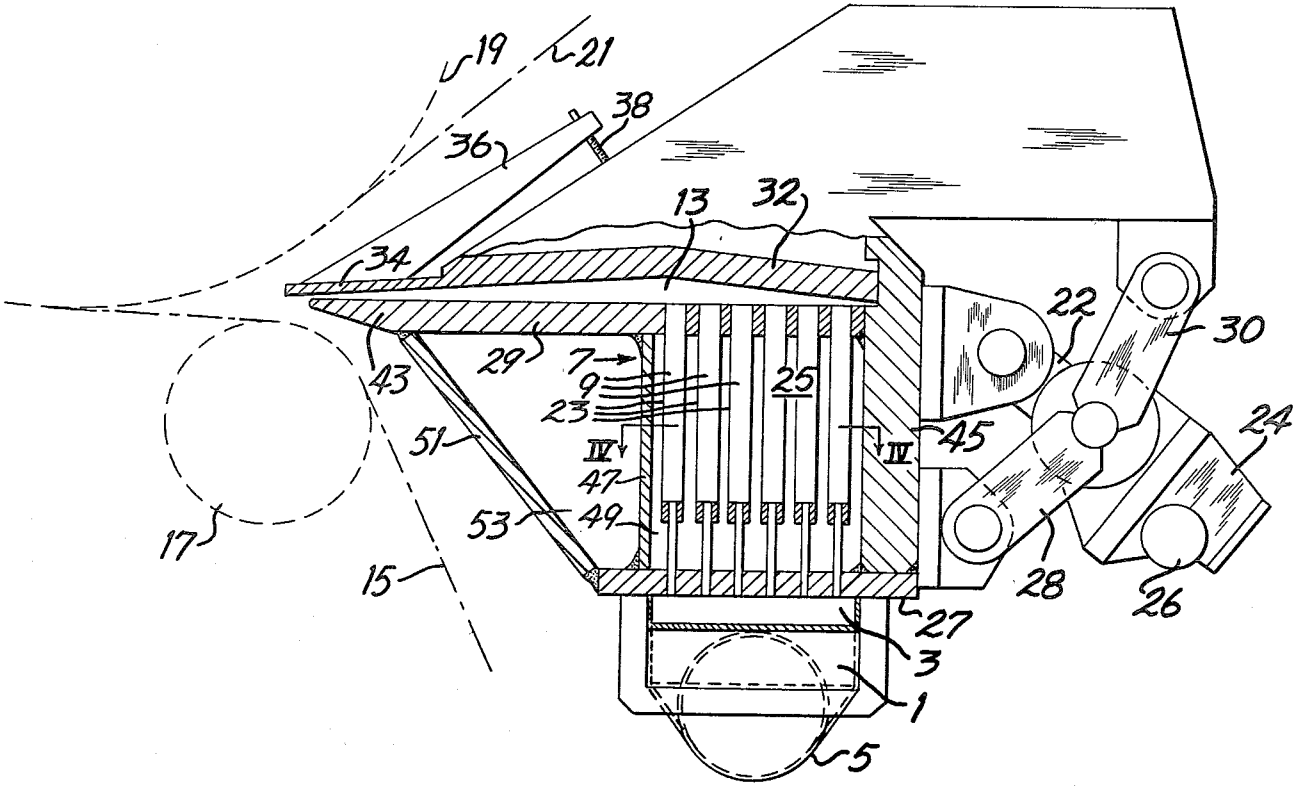
FIG. 1 is a schematic side view in vertical section of a headbox constructed according to the invention.

The headbox shown in FIG. 1, which is of the closed type without air cushion, i.e., a stock nozzle, comprises a cross machine distributor 1 having a mixing chamber extending from one side of the machine to the other for uniform distribution of the stock. The stock enters the mixing chamber 3, which is shown as rectangular in cross section although it could be e.g. circular, through a pipe 5 from a pump (not shown). The cross sectional area of the mixing chamber 3 diminishes continuously from its inlet end at one side of the machine to its outlet end at the other side of the machine, and part of the stock flow is recirculated through the outlet end. Usually the cross sectional area of the mixing chamber at the outlet end is between 2% and 15% of its cross sectional area of the inlet end.

Figure 4:
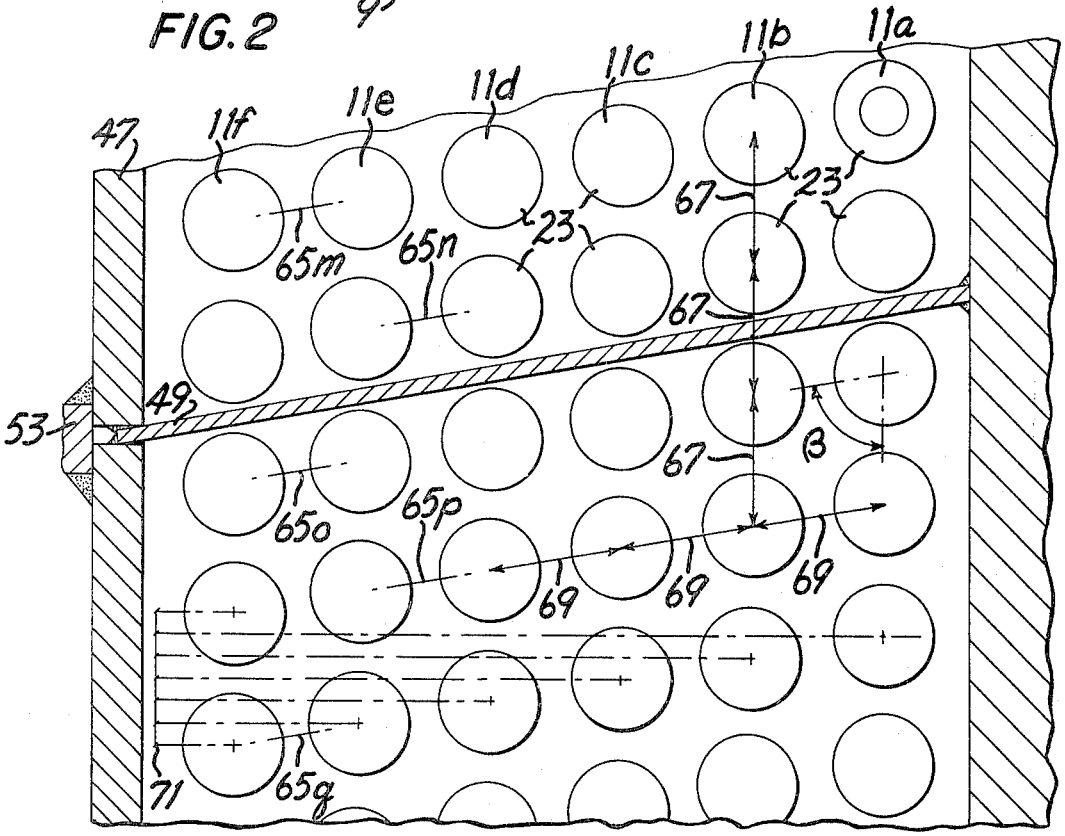
FIG. 4 is a partial view in horizontal section taken along the line IV—IV of FIG. 1 looking in the direction of the arrows and showing how the tubes are arranged in the tube bank.

The cross machine distributor 1 has one side directly connected to stock flow aligning means 7 having a plurality of flow channels 9 arranged in rows 11*a* through 11*f* which extend substantially in the cross machine direction, as shown in FIG. 4. At least those channels in the same row are parallel to each other and all of the channels 9 increase stepwise in cross sectional area in the direction of stock flow therethrough. The distance from the outlet end of the channel to the step where the increase in cross sectional area takes place, or the last step in the channel if there are several stepwise increases, is suitably of such length that cross flow tendencies in the stock are at least substantially eliminated. In general, that distance should be at least five times greater than the hydraulic diameter of the corresponding portion of the channel 9.

The flows of stock leaving the outlets of the channels 9 are discharged into a nozzle chamber 13, which in FIG. 1 diverges rearwardly opposite the machine direction so that upon discharge from the outlets the stock is deflected almost through a right angle. The stock then flows without appreciable deviation into and through a nozzle portion, converging in the machine direction, from which it is discharged in the form of a machine-wide, comparatively thin jet. This jet impinges at a small angle on a forming surface, shown in FIG. 1 as an endless wire 15 which runs over a breast roll 17 and then follows the surface of a forming roll 19 through a wrap angle of between about 1 radian and $\pi$ radians. If desired, the wire 15 can be an outer wire adapted to run with an inner wire 21 in the known manner, in which case the wires preferably should leave the forming roll simultaneously. Suitably, the jet should strike the forming surface at or immediately before the point where the outer wire 15 begins to curve along the surface of the forming roll 19.

According to the invention, a bank 25 of channels 9 is formed by a plurality of laterally unsupported composite tubes 23 extending between a pair of spaced apart tube plates 27 and 29 which are perforated to receive the opposite ends of the tubes. The tube plates 27 and 29 may be flat plates approximately 30 mm and 50 mm, respectively, in thickness, and the downstream plate 29 may be made wide enough in the machine direction to extend to the nozzle outlet, where it forms a lip 43. The plates 27 and 29 are welded to a very rigid rear wall 45 and to a thinner front wall 47, which may be 90 mm and 20 mm, respectively, in thickness, and which form therewith a right angle parallelepiped-shaped box structure enclosing the tube bank 25.

The box structure is reinforced by a plurality of web plates 49 extending substantially in the machine direction from the rear wall 45 to the front wall 47 and from one tube plate 27 to the other 29, and are welded to the walls 45 and 47 and the tube plates 27 and 29. For additional reinforcement, a front inclined wall 51 is welded to a front edge of the tube plate 27 and to the lip 43, and a plurality of vertical plates extend in the machine direction from the front wall 47 to the front inclined wall 51 between the tube plates 27 and 29 and are welded to the tube plates 27 and 29 and to the walls 47 and 51. In order to facilitate welding of these parts as described, the front wall 47 and the front inclined wall 51 preferably are made up of sections extending in the cross machine direction between adjacent plates 49 and 53, as shown in FIG. 4.

The slice opening is adapted to be adjusted by a screw 22, one end of which is pivotally mounted on the rear wall 45 at about the same level as the downstream tube plate 29. A nut (not shown) rotatably supported in a housing 24 is adapted to be rotated by means of a hand-wheel 26 to move the nut and housing 24 along the screw 22. The housing 24 has pivotally mounted thereon a pair of links 28 and 30 of like length, one of which is pivotally attached at its other end to the rear wall 45 at about the level of the downstream tube plate 27, and the other of which is pivotally attached at its other end of a structure rigidly supporting a rigid plate 32. The plate 32 is slightly bent, as shown, and it cooperates with the tube plate 29 to define the nozzle chamber 13, its outer nozzle end being reduced in thickness to form a second lip 34.

Rotation of the hand-wheel 26 causes the lips 34 and 43 to move towards or away from each other depending upon the direction of rotation. For fine adjustment of the slice opening profile in the cross machine direction, a plurality of beams 36 project obliquely rearwardly from the second lip 34 and have set screws 38 at their front ends.

Figure 2:
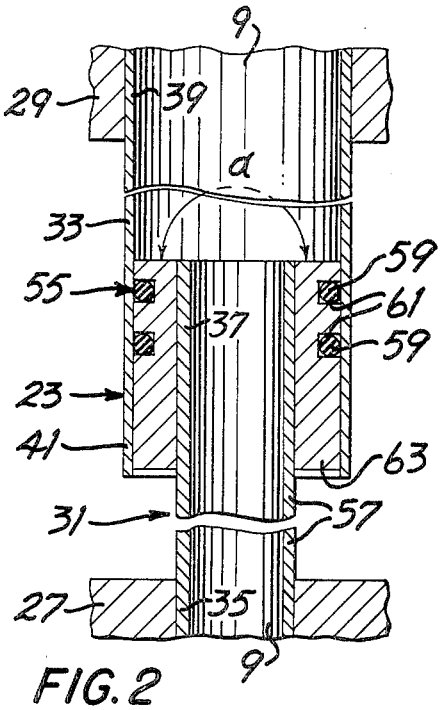
FIG. 2 is a view in vertical section of one of the composite tubes in FIG. 1 to a larger scale.

Referring now to FIG. 2, each composite tube 23 comprises a slender tubular element 31 comprising a tube 57 of given, relatively small cross section, having one end 35 sealingly mounted in the upstream tube plate 27 and a free end 37 extending in telescoping relation into the free end of a tubular element 33 of greater cross sectional area, the other end 39 of which is sealingly mounted in the downstream tube plate 29. Mounted on the free end 37 of the tubular element 31 is a sealing member 55 comprising a sleeve 63 which occupies the space between its outer diameter and the inner diameter of the free end 41 of the other tubular element 33. Conventional sealing means such as sealing rings 59 disposed in grooves 61 formed in the sleeve 63 are provided to form a liquid-tight joint where the tubular elements 31 and 33 are telescoped together.

By reason of the telescoping relation between the free ends 37 and 41 of the composite tubes 23, any changes in length caused by thermal expansion can readily be accommodated without damage to the apparatus. Moreover, the telescoping joint between the free ends of the two tubular elements constituting each composite tube provides a stepwise increase in the cross sectional area of the tube in the direction of flow.

The radial sealing rings 59 may be conventional rubber O rings and the larger tubular element 33 may be of constant diameter along its length. The tubes 31 and 33 may be press fitted into holes in the tube plates 27 and 29 to mount them sealingly therein, although the tubes may be sealingly mounted in other ways known to those skilled in the art, e.g. by welding or brazing. The sleeve 63 may be mounted on the free tube end 37 in the same way, or it can be made integral with the tubular element 31. It is also possible for the sleeve 63 to be eliminated, in which case circumferential grooves 61 may be formed in the outside wall of the tubular element 31 to receive the sealing means 59. Where this is done, the outer diameter of the tubular element 31 should be just smaller enough than the inside diameter of the tubular element 33 to enable the free end of the former to be snugly received in the free end of the latter.

Figure 3:
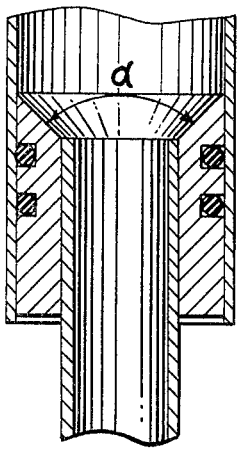
FIG. 3 is a view in vertical section illustrating schematically another form of composite tube according to the invention.

The flow channel 9 should diverge at the free end 37 of the tubular element 31 by an aperture angle $\alpha$ between about 1 radian and about $\pi$ radians. Thus, in FIG. 2, the angle $\alpha$ is approximately $\pi$ radians, while in FIG. 3 it is approximately $\pi/2$ radians, which is preferred.

In practice, the tubular element 31 may have an inside diameter of 16 mm and a length of 150 mm, for example, and the larger tubular element 33 an inside diameter of 35 mm and a length of 360 mm, the effective length downstream of the sleeve 63 being 330 mm. These values can vary within wide limits, however, provided that at maximum stock flow the flow velocity through the smallest part of the tubular element 31 is preferably about 10 m/s, the pressure drop is around 80 kPa, and the effective length downstream of the sleeve 63 is at least 5 and preferably at least 8 times the inside diameter of the larger tubular element 33.

In FIG. 4, the composite tubes 23, which are illustrated as circles for the sake of simplicity, are shown disposed in rows 11*a* through 11*f* and columns 65*m* through 65*q*, the angle $\beta$ between each row and column being about 1 radian and $\pi/2$ radians.

Preferably, there should be at least 5 rows of composite tubes arranged at equal pitches 67 and 69 within the several rows and columns. In addition, the angle $\beta$, which may be oblique, and the pitches 67 and 69 are selected in such manner that the projections of the center lines of all of the composite tubes 23 on a plane 71 parallel to those center lines and extending in the cross machine direction are located at equal distances from each other. In this way, the most uniform distribution of stock possible can be achieved in the cross machine direction. Thus, in FIG. 4 the angle $\beta$ may be 1.4 radians, the pitch 67 in the rows 11*a*–11*f* 55 mm, and the pitch 69 in the columns 65*m*–65*q* 55 mm on projection to a plane extending in the machine direction, i.e. the pitch 69 seen in the lengthwise direction of the columns 65*m*–65*q* is slightly larger (approximately 1.5% larger) than the pitch 67 for the rows 11*a*–11*f*.

Utilization of an oblique angle $\beta$ avoids streak formation but results in some non-uniformity in the stock distribution at the two edges of the web. Where a uniform distribution at the edges is desired and possible slight streak formation is acceptable, the angle $\beta$ should be about 90°, i.e. the tubes 23 should form a rectangular array.

Mounting the composite tubes 23 into the tube plates 27 and 29 to form the tube bank 25 is a simple procedure. First, the smaller tubular element 31 is pushed into the larger tubular element 33 until it is in approximately the correct position and the tubular element 31 is first inserted through a hole in the downstream tube plate 29. Then one end of the composite tube 23 is secured in its hole in one of the tube plates by pressing, welding, brazing, or otherwise, after which the length of the composite tube is adjusted to bring the other end in the desired position in the other tube plate, in which it is securely mounted in the same way. Obviously, all of the larger tubular elements may be secured in the downstream tube plate first and then the smaller tubular elements secured in their upstream tube plate, or the tubular elements may be mounted in the reverse order if desired.

Figure 5:
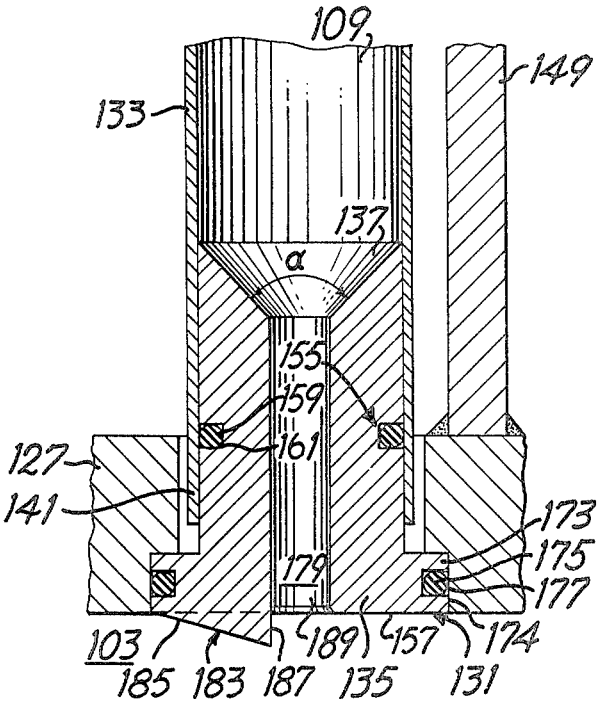
FIG. 5 is a view in vertical section illustrating a modification of the composite tube shown in FIG. 2.

The smaller tubular element 31 may be constituted by a bushing, as shown in FIG. 5. In this figure, features common to this embodiment and other embodiments described above are designated by corresponding reference numerals in the 100 series. Thus, in FIG. 5, the smaller tubular element comprises a bushing 157, having a flange 173 at one end 135 adapted to be received within a groove 174 formed in the upstream side of the upstream tube plate 127, and a free end 137. The outside diameter of the free end 137 is slightly smaller than the inside diameter of the larger tubular element 133 at its free end 141, and it is provided with a sealing member 155 comprising at least one radial sealing ring 159 in a circumferential groove 161. Suitable means such as an O ring 175 may be disposed in a groove 177 to seal the joint between the flange 173 and its groove 174.

By mounting the flange 135 of the bushing 157 in a groove 174 in the upstream side of the upstream tube plate 127, the bushing 157 can be securely retained in the recess and yet be detachable in the direction opposite the direction of flow. This facilitates removal of the bushing 157 if considered desirable for inspection and changing the radial sealing ring 159.

If desirable, the bushing 157 can be externally threaded (not shown) so as to enable it to be screwed into an internal thread formed in the opening in the upstream tube plate 127. In such case, the upstream end face of the bushing 157 may be provided with one or more dead-end holes (not shown) adapted to cooperate with the central hole 189 in the bushing to provide a grip for a conventional pin spanner having a pair of cylindrical pins adapted to fit into these two holes.

Figure 7:
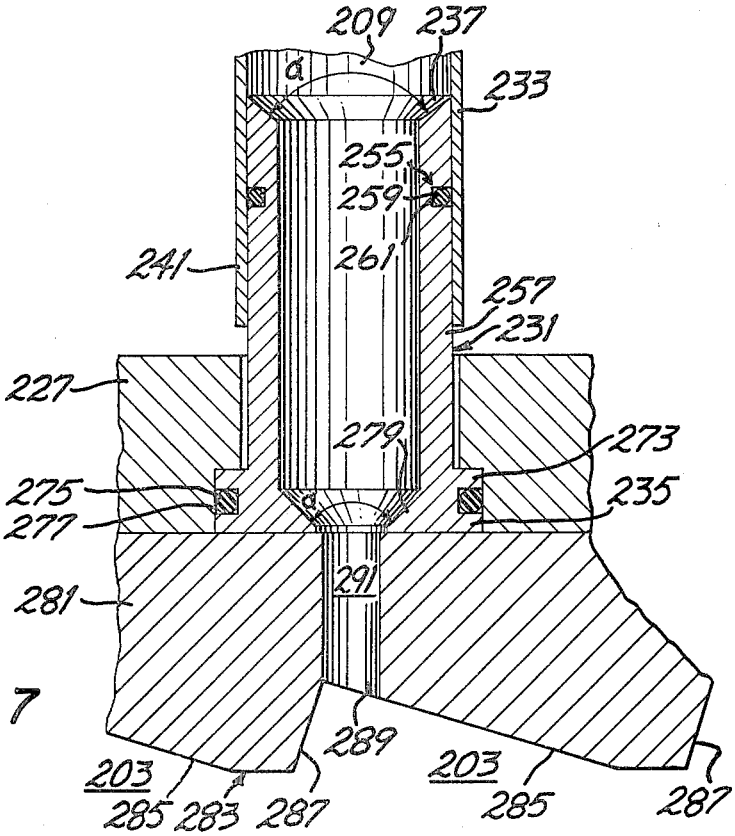
FIG. 7 is a view in vertical section similar to FIG. 5, showing a modified form of bushing and flow deflector.

The bushing 157 is formed with a stock flow restricting bore 179 in the form of a conventional orifice or measuring flange through which the stock flows. Due to the pressure drop existing across the bushing, it is always retained in the correct position during operation. If, however, the flow of stock therethrough, and thus the pressure drop across the bushing, ceases and the bushing is located in a bottom end of the composite tube, it is sometimes possible that the stock may flow back through the tube with such force that the sealing rings 159 and 175 are not capable of retaining it in its intended position. In such cases, suitable means such as a screw (not shown) may be threaded into the tube plate 127 at the edge of the recessed hole for retaining the bushing 157 in position. A hole plate can be secured over the upstream end of the bushing for the same purpose, as shown in FIG. 7.

Since the direction of stock flow towards the inlet 189 of each flow channel 109 forms an angle with the direction of stock flow through the bushing, it is desirable to provide flow deflectors 183 on the upstream surface of the bushings 157 to prevent fibers from collecting at the downstream edge of the inlet in the direction of stock flow. Where such fibers are allowed to collect, the stock flow through the inlet is affected unfavorably and clumps of fibers can be carried to the headbox and discharged onto the wire to impair the quality of the paper produced. Such flow deflectors 183 should be located immediately upstream of the inlet 189 in the direction of flow and should project from the upstream surface of the bushing 157 into the mixing chamber 103. Also, they should be provided with a slowly rising upstream side 185 to give the flow a component in the direction opposite the direction of flow through the inlet 189, and a steep downstream side 187, as shown in FIG. 5, sloping abruptly towards the inlet 189.

Figure 6:
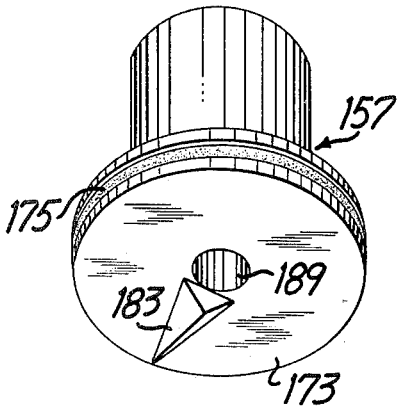
FIG. 6 is a perspective view of one of the tubular elements in FIG. 5 which is in the form of a bushing with a flow deflector.

As shown in FIGS. 5 and 6, each of the flow deflectors 183 has an increasing height and width in the direction of flow. The height and width are greatest at the inlet 189, where the width is suitably between 90% and 100% of the diameter of the inlet 189, and the height is suitably at least half the inlet diameter. The length of the flow deflector 183 should be such that its angle of inclination from the end face of the bushing is at most about 0.35 radians. Instead of having a triangular cross section as shown, at right angles to the direction of flow, the flow deflector 183 can be rounded, e.g. semi-circular, or rectangular in cross section, with a width that is constant or increases in the direction of flow, so as to reduce the risk of fibers collecting at a sharp edge.

In FIG. 5, a reinforcing web plate 149 is welded to the tube plate 127 and the diameter of the hole in the upstream tube plate 127 through which the bushing 157 projects is preferably made somewhat larger than the outer diameter of the larger tubular element 133 at its free end 141 so that the latter projects into the opening as shown, thus allowing the length of the bushing 157 to be reduced. Except for the flow deflectors 183, the end face of the bushing 157 facing axially towards the mixing chamber 103 is level with the end face of the tubular plate 127, so that no edges exist at the transition between these two surfaces on which fibers could collect and form a clump.

In the modification shown in FIG. 7, features in common with the embodiments shown in FIGS. 5 and 6 are designated by corresponding reference characters in the 200 series. In FIG. 7, the flow deflectors 283 are formed on a hole plate 281 instead of on the upstream faces of the bushings 257. The hole plate 281 has flow restricting bores 291 therein aligned with the bores in each of the bushings 257 and is detachably mounted on the upstream side of the upstream tube plate 227 in contact with the bushings 257. The bores 291 are arranged in rows and columns in correspondence with the rows and columns of the composite tubes. Also, each flow deflector 283 is common to all of the bores 291 in a given column. Desirably, the flow deflectors may be formed by cutting grooves in the hole plate 281, which can be made of metal or a suitable plastic such as polymethylmethacrylate. The grooves are substantially triangular in cross section and their lengthwise direction is parallel to the columns of bores. The hole plate 281 is preferably of the type disclosed in U.S. Pat. No. 3,535,203.

The bores 291 in the hole plate 281 may be smaller in cross sectional area than the interior diameters of the bushings 257, which, in turn, may be smaller than the interior cross sectional areas of the free ends 241 of the tubular elements 233, thus providing two stages of stepwise increase in the cross sectional area of the composite tubes 209, each at an aperture angle $\alpha$. Also, it will be understood that, if desired, either or both of the tubular elements may be modified to constitute an arbitrary number of expansion stages, as required.

While the invention has been illustrated as embodied in apparatus for aligning a single furnish in the production of a single layer web, it will be understood that it is equally applicable to the alignment of a plurality of separate furnishes to be formed into the several layers of a multilayer product. In such case, the mixing chamber 3 may be provided with a plurality of partitions running in the cross machine direction and dividing it into a plurality of mixing chambers, each provided with a separate inlet port through which it receives stock. Each mixing chamber supplies stock to a separate group of telescoped composite tubes constituting flow aligning means according to the invention from which stock flows, respectively, into a plurality of superimposed nozzle chambers in which the flows converge in the machine direction to a plurality of nozzle portions, from which stock is discharged in the form of a plurality of adjacent, superimposed, machine-wide sheets.

The specific embodiments described above are intended to be illustrative only and are susceptible of modification in form and detail without departing from the spirit of the invention. For example, the tube bank can be designed to provide a direction of flow which becomes substantially parallel to the direction of flow in the nozzle chamber. Moreover, the tube plates need not be flat but can be curved in the form of a cylindrical arc with a common center of curvature so that the composite tubes will extend substantially radially between the tube plates, the tube plate located upstream having a larger radius of curvature. The web plates do not always need to be welded to the upstream tube plate, and in low pressure headboxes for use at low speeds (i.e., below or equal to about 600–700 m/min) they can usually be dispensed with. The invention is intended to encompass all such modifications as fall within the scope of the following claims.

We claim:

1. In stock flow alignment means for the headbox of a paper machine or the like, the combination of upstream and downstream apertured tube plates extending in the cross machine direction and spaced apart in the direction of stock flow, and a bank of laterally unsupported, composite tubes secured at their opposite ends in apertures in said respective tube plates and extending in the direction of stock flow, each of said composite tubes comprising a first tubular element of a given inner and outer diameter having one end secured in an aperture in said upstream tube plate and having a free end extending into the free end of a second tubular element with a greater inner diameter than the outer diameter of the first tubular element, the other end of said second tubular element being secured in an aperture in said downstream tube plate, and retaining means positioned between and retaining the overlapping free ends of each of said first and second tubular elements in telescoping, liquid tight relation to form a plurality of channels, each increasing stepwise in cross section in the direction of stock flow.

2. Headbox stock flow alignment means as defined in claim 1 in which the outside diameter of the free end of each of the first tubular elements is only slightly smaller than the inside diameter of the free end of the second tubular element into which it extends, and said retaining means comprises sealing means for sealing the joint between said telescoped free ends.

3. Headbox stock flow alignment means as defined in claim 1 in which said retaining means comprises:

an outer sleeve provided at the free end of each of the first tubular elements, said outer sleeve having an outer diameter only slightly less than the inside diameter of the free end of the second tubular element in which the free end of the first tubular element extends; and sealing means in the periphery of said outer sleeve for sealing the space between the sleeve and the inside diameter of the free end of the second tubular element.

4. Headbox stock flow alignment means as defined in claim 1 in which each of the first tubular elements comprises a bushing having a central bore, each of said bushings being sealingly mounted in an aperture in the upstream one of said tube plates so as to be removable therefrom only in the upstream direction and being slightly smaller in outside diameter at the free end than the inside diameter of the free end of the second tubular element into which it extends; and said retaining means comprises sealing means provided for sealing the joint between said telescoped free ends.

5. Headbox stock flow alignment means as defined in claim 4 in which the upstream tube plate is provided with shouldered apertures and the bushings are provided with outwardly extending flanges adapted to be snugly received in said shouldered apertures, respectively.

6. Headbox stock flow alignment means as defined in claim 5 in which the diameters of the apertures in the upstream tube plate are greater than the outer diameters of the free ends of the second tubular elements, and the free ends of said second tubular elements extend part way into said apertures from the downstream side thereof.

7. Headbox stock flow alignment means as defined in claim 6 in which the upstream faces of the bushings are level with the upstream face of the upstream tube plate.

8. Headbox stock flow alignment means as defined in claim 7 in which the bushings are provided with flow restricting means.

9. Headbox stock flow alignment means as defined in claim 1 or claim 4, together with a hole plate detachably mounted on the upstream side of the upstream tube plate and provided with a plurality of flow restricting means communicating with the respective apertures therein.

10. Headbox stock flow alignment means as defined in claim 2 together with flow deflector means for said composite tubes, said flow deflector means being disposed at the upstream inlets of said tubes and being shaped to deflect the flow of liquid in a direction with a component opposite the direction of flow of liquid through said composite tubes as the liquid approaches the upstream inlets thereto.

11. Headbox stock flow alignment means as defined in claim 7 together with flow deflector means on the upstream faces of at least some of said bushings, said deflector means being disposed near the bores in said bushings, respectively, and each having an upstream side sloping gradually away from the upstream face of its bushing and a downstream side sloping steeply and abruptly towards the inlet to its bushing.

12. Headbox flow alignment means as defined in claim 9 together with flow deflector means mounted on the upstream face of said hole plate, said flow deflector means being disposed near at least some of the flow restricting means thereon, respectively, and having an upstream side sloping gradually away from the upstream face of the hole plate and a downstream side sloping steeply and abruptly towards its nearby flow restricting means.

13. Headbox flow alignment means as defined in claim 1, in which the flow channel at the free end of each first tubular element diverges at an aperture angle $\alpha$ between about 1 and about $\pi$ radians.

14. Headbox flow alignment means as defined in claim 13 in which the angle $\alpha$ is about $\pi/2$ radians.

15. Headbox flow alignment means as defined in claim 1 in which the flow channel through each composite tube is formed with at least two stepwise increases in cross section in the direction of flow, at each of which the flow channel diverges at an angle $\alpha$ between about 1 and about $\pi$ radians.

16. Headbox flow alignment means as defined in claim 1 in which the composite tubes are disposed in columns and rows extending in the machine and cross machine direction, the former being disposed at an angle $\beta$ between about 1 radian and about $\pi/2$ radians with respect to the latter and reinforcing means is disposed between the columns of tubes and is rigidly secured to said tube plates.

17. Headbox flow alignment means as defined in claim 16 in which there are at least five rows of composite tubes and the pitches of the composite tubes in the rows and columns are equal.

18. Headbox flow alignment means as defined in claim 17 in which the angle $\beta$ between the rows and columns is oblique and the projections of the center lines of the composite tubes on a plane parallel thereto are mutually equidistant from each other.

* * * * *

UNITED STATES PATENT AND TRADEMARK OFFICE

CERTIFICATE OF CORRECTION

PATENT NO. : 4,225,386

DATED : September 30, 1980

INVENTOR(S) : Karl G. Edblom et al.

It is certified that error appears in the above—identified patent and that said Letters Patent is hereby corrected as shown below:

First page, following Item [22], insert:

[30] Foreign Application Priority Data

Mar. 23, 1978 Sweden.....7803387

Column 4, line 39, "of" should read --to--.

Signed and Sealed this

*Thirteenth* Day of *January 1981*

[SEAL]

*Attest:*

SIDNEY A. DIAMOND

*Attesting Officer*

*Commissioner of Patents and Trademarks*